US009831597B2

(12) United States Patent
Amini et al.

(10) Patent No.: US 9,831,597 B2
(45) Date of Patent: Nov. 28, 2017

(54) FLEXIBLE AND BREAKAWAY MECHANISMS FOR CONNECTORS

(71) Applicant: Apple Inc., Cupertino, CA (US)

(72) Inventors: Mahmoud R. Amini, Sunnyvale, CA (US); Mani Razaghi Kashani, San Francisco, CA (US); Peter J. Cameron, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/260,239

(22) Filed: Sep. 8, 2016

(65) Prior Publication Data

US 2017/0133787 A1 May 11, 2017
US 2017/0302021 A9 Oct. 19, 2017

Related U.S. Application Data

(60) Provisional application No. 62/254,084, filed on Nov. 11, 2015, provisional application No. 62/215,620, filed on Sep. 8, 2015.

(51) Int. Cl.
*H01R 13/56* (2006.01)
*H01R 43/20* (2006.01)
*H01R 13/58* (2006.01)

(52) U.S. Cl.
CPC ..... *H01R 13/56* (2013.01); *H01R 13/58* (2013.01); *H01R 43/20* (2013.01)

(58) Field of Classification Search
CPC ..... H01R 13/56; H01R 13/58; H01R 43/20; H01R 13/2421
USPC ..... 439/700, 445
See application file for complete search history.

(56) References Cited

U.S. PATENT DOCUMENTS

| | | | | |
|---|---|---|---|---|
| 7,909,660 | B2 * | 3/2011 | Tsunoda | H01R 12/714 439/700 |
| 8,585,415 | B2 * | 11/2013 | Marsh | H01R 9/0527 439/98 |
| 8,690,583 | B2 * | 4/2014 | Uesaka | H01R 12/714 439/63 |
| 2003/0016917 | A1 | 1/2003 | Finona et al. | |
| 2012/0045924 | A1 | 2/2012 | Harnish et al. | |
| 2012/0315083 | A1 * | 12/2012 | Rosenberger | H01R 13/502 403/316 |
| 2013/0029513 | A1 | 1/2013 | Montena | |
| 2013/0244492 | A1 * | 9/2013 | Golko | H01R 13/516 439/660 |

OTHER PUBLICATIONS

International Search Report and Written Opinion dated Nov. 17, 2016 in PCT/US2016/050812, 12 pages.

* cited by examiner

*Primary Examiner* — Harshad Patel
(74) *Attorney, Agent, or Firm* — Kilpatrick Townsend & Stockton, LLP

(57) ABSTRACT

Connectors that are able to withstand force and are easy to manufacture. The connectors may include connecting portions that may move relative to other portions of the connectors to absorb force. The connectors may be designed to partially break in order to protect devices that may be connected to. The connectors may be further designed to break in a controlled manner to prevent springs or other components that may be under compression from being dislodged from the connectors.

20 Claims, 12 Drawing Sheets

FLEXIBLE AND BREAKAWAY MECHANISMS FOR CONNECTORS

CROSS-REFERENCES TO RELATED APPLICATIONS

This application is a nonprovisional of U.S. provisional patent application Nos. 62/215,620, filed Sep. 8, 2015, and 62/254,084, filed Nov. 11, 2015, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various connectors. The devices may connect to each other through cables, where a cable has a connector insert on each end to mate with connector receptacles on the communicating devices. In some electronic systems, a first device may include a connector receptacle while a second device may include a connector insert. In these systems the connector insert on the second device may be inserted into the connector receptacle on the first device without the need of an intervening cable.

Systems where a second device having a connector insert is inserted directly into a connector receptacle on a first device may be susceptible to damage. For example, a force applied to the second device may translate to a force applied to the connector insert in the corresponding connector receptacle. If this force is sufficient, damage to the connector receptacle and its device, the connector insert and its device, or both, may occur.

Electronic devices may be sold in the millions, with an attendant number of connectors sold with them. With such volumes, any reduction or simplification in the manufacturing of a connector becomes significant. For such reasons, it may be desirable that these connectors are readily manufactured.

Thus, what is needed are connectors that are able to withstand force and are easy to manufacture.

SUMMARY

Accordingly, embodiments of the present invention may provide connectors that are able to withstand inadvertent forces and are easy to manufacture. The connectors may each include a connecting portion that may move relative to other portions of the connector to absorb energy and deflect to relieve force in displacement controlled abuse scenarios. The connectors may be designed to partially break in order to protect devices that the connectors may be connected to. The connectors may be further designed to break in a controlled manner to prevent springs or other components that may be under compression from being dislodged from the connectors.

An illustrative embodiment of the present invention may provide a connector having a connecting portion that supports a number of contacts. The connecting portion may have a rear portion tapered as a flange. The flange may fit against a ring around an inside surface of a collar, where the ring prevents the flange from exiting from a front of the collar, but may allow travel towards a rear of the collar. The connector may further include a barrel having a front end secured to a rear portion of the collar. A spring in the barrel may push against the flange of the connecting portion such that the flange is in contact with the ring unless a force is applied to the connecting portion. The spring may provide sufficient force against the flange to prevent movement by the connector portion in the absence of energy or force applied to the connector portion. This may also discourage users from casually applying force to the connector portion. A plunger may also be located at least partially in the barrel. The plunger may have a narrow portion surrounded by the spring. The narrow portion of the plunger may have an end extending through a rear opening in the barrel. A C-clip or other fastener may be located at the end of the narrow portion of the plunger that extends beyond the barrel. The plunger may have a wider portion between the spring and a rear of the flange of the connecting portion.

In this configuration, the connecting portion may travel backward into the collar when a force is applied to the connecting portion. Features may be provided on the connecting portion and the collar to prevent rotation of the connecting portion relative to the collar, which could strain and damage wired connections in the connector. These features may include ribs on an inside surface of the collar and corresponding tabs on the flange of the connecting portion. These ribs and tabs may provide a positive restore feature such that the connecting portion may return to an original position relative to the collar following a deflection of the connecting portion. Specifically, the ribs on the collar and the tabs on the connecting portion flange may help to limit a rotation of the connecting portion relative to the collar during and after a deflection. As a force causing the deflection ceases, the force provided by the spring against the flange of the connecting portion may move the flange and connecting portion forward towards its original position. The tabs on the flange of the connecting portion and ribs on the collar may guide the connecting portion such that its original orientation is restored. The ribs may include side ramps to help guide the connecting portion back its original orientation.

An illustrative embodiment of the present invention may provide a connector insert that may be designed to break before damage occurs to a corresponding connector and its device. In one example, the connector may be a connector insert and the barrel may be secured to the collar by use of tabs that may be designed to break before the connector receptacle is damaged. These tabs may break, thereby disconnecting the barrel from the collar in the connector insert.

When these tabs break, it may be undesirable for the spring, which may be under compression, to exit the barrel. Accordingly, the spring may be secured between a rear of the barrel and a wide portion of the plunger. The plunger may be under force by the spring in a direction that would have the plunger exiting the barrel. The plunger may be secured to the barrel by the C-clip or other fastener that may be located around and end of the plunger that extends beyond the barrel, thereby preventing the plunger from exiting the barrel. In this way, the plunger, the barrel, the spring, and the C-clip form a unit that may stay together after the tabs on the barrel are broken. This may prevent the spring from being ejected from the barrel during such an event.

An illustrative embodiment of the present invention may provide a connector that is readily assembled. A plunger may have a rear narrow portion that tapers towards a front to a wider portion. A spring may be fit around a narrow portion of the plunger such that one end of the spring fits against a wider portion of the plunger. An end of the narrow portion of the plunger may be fit through an opening in a rear of a barrel, thereby compressing the spring. A C-clip or other fastener may be fit around the end of the narrow portion of the plunger that extends through the opening in the rear of the barrel. The C-clip may simplify assembly by securing the plunger, barrel, and compressed spring together as a unit. This C-clip may also secure the plunger and prevent the spring from ejecting the plunger from the barrel. In this way, the plunger, the spring, the barrel, and the C-clip may form a secure unit that may hold together during a destruction of the connector, thereby preventing the compressed spring from exiting a broken connector.

A connecting portion may include contacts towards a front end, where the connecting portion tapers to a wider rear flange portion. A front end of the connecting portion may be inserted into a collar, where the collar may include a ring to prevent further forward travel of the connecting portion. The barrel may be secured to rear portion of the collar such that the plunger contacts a rear of the flange. This may cause the spring to push the plunger against the flange, thereby keeping the flange in contact with the ring on the inside of the collar, in the absence of a force on the connecting portion. The barrel may be secured to the collar by using interlocking tabs on the barrel and on the inside of the collar. These interlocking tabs may be fixed together, for example by soldering, spot welding, or laser welding, to secure the barrel to the collar. The tabs on the barrel may be designed to breakaway before damage may be done to a device that the connector is connected to.

In various embodiments of the present invention, the components of the connectors may be formed in various ways of various materials. For example, contacts and other conductive portions may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle housings, contact pucks, and other portions, may be formed using injection or other molding, 3-D printing, machining, stamping, forging, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide connectors that may be located in, or may connect to, various types of devices, such as portable computing devices, tablet computers, desktop computers, laptops, all-in-one computers, wearable computing devices, cell phones, smart phones, media phones, storage devices, keyboards, covers, cases, styluses, portable media players, navigation systems, monitors, power supplies, adapters, remote control devices, chargers, and other devices. These connectors may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
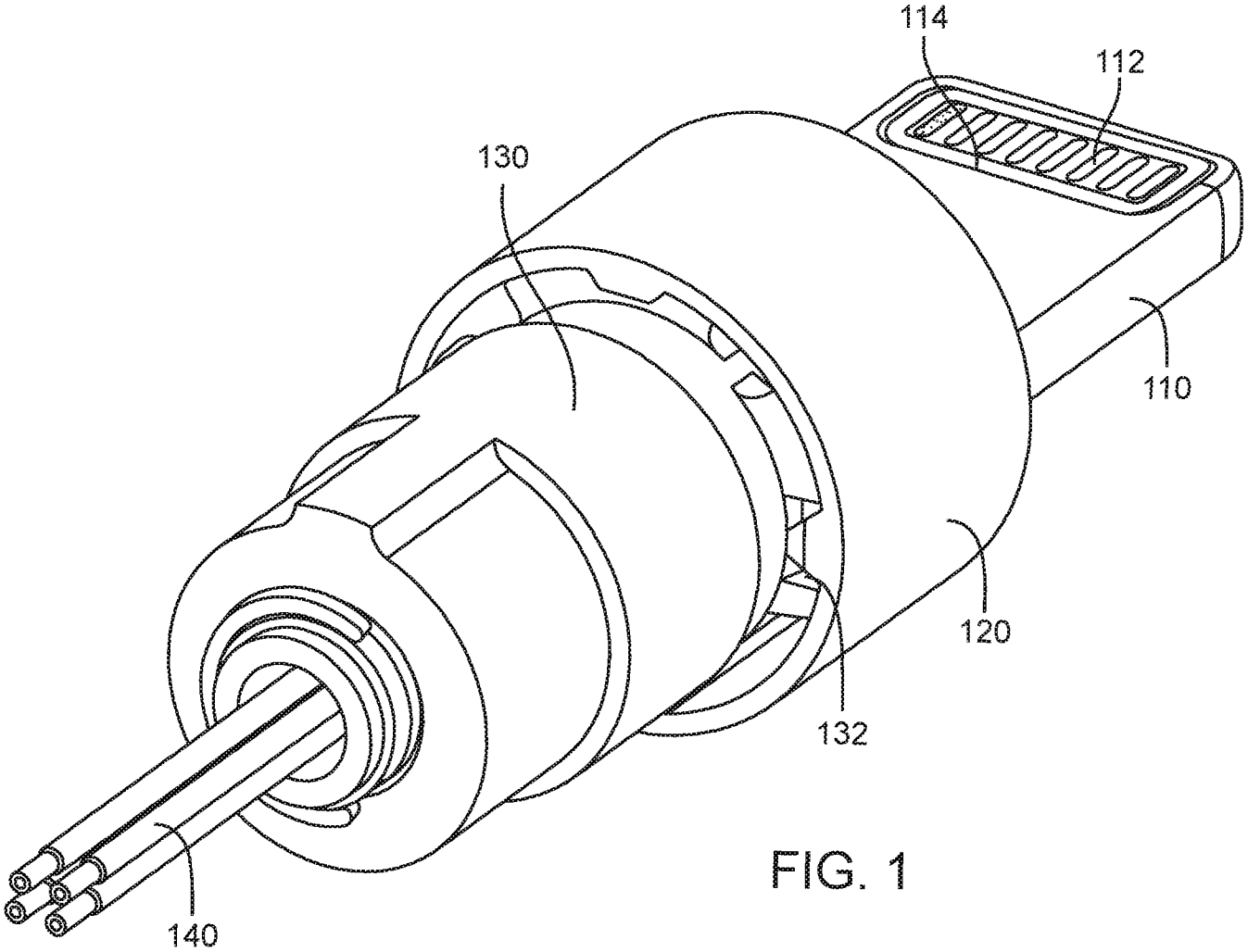
FIG. 1 illustrates a rear oblique view of a connector according to an embodiment of the present invention.

FIG. 1 illustrates a rear oblique view of a connector according to an embodiment of the present invention. This figure, as with the other included figures, is shown for illustrative purposes and does not limit either the possible embodiments of the present invention or the claims.

This connector may include a connecting portion 110 supporting a number of contacts 112 in opening 114. A collar 120 may mechanically secure connecting portion 110 to barrel 130. Barrel 130 and collar 120 may be joined by interlocking tabs 132, as will be shown below. Contacts 112 may electrically connect to wires 140, which may emerge from a rear opening of barrel 130 and plunger (described in FIG. 6.).

Figure 2:
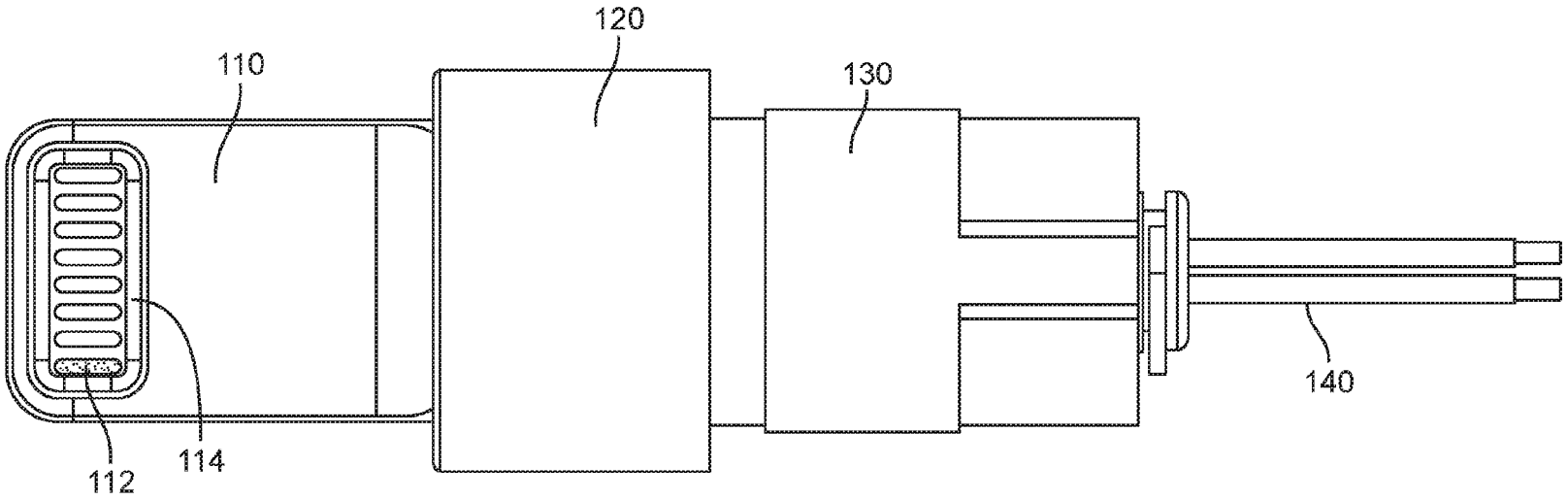
FIG. 2 illustrates a top view of a connector according to an embodiment of the present invention.

FIG. 2 illustrates a top view of a connector according to an embodiment of the present invention. Again, this connector may include connecting portion 110 supporting a number of contacts 112 in an opening 114. Collar 120 may mechanically secure connecting portion 110 to barrel 130. Wires 140 may electrically connect to contacts 112 and may emerge from a rear opening of barrel 130.

Figure 3:
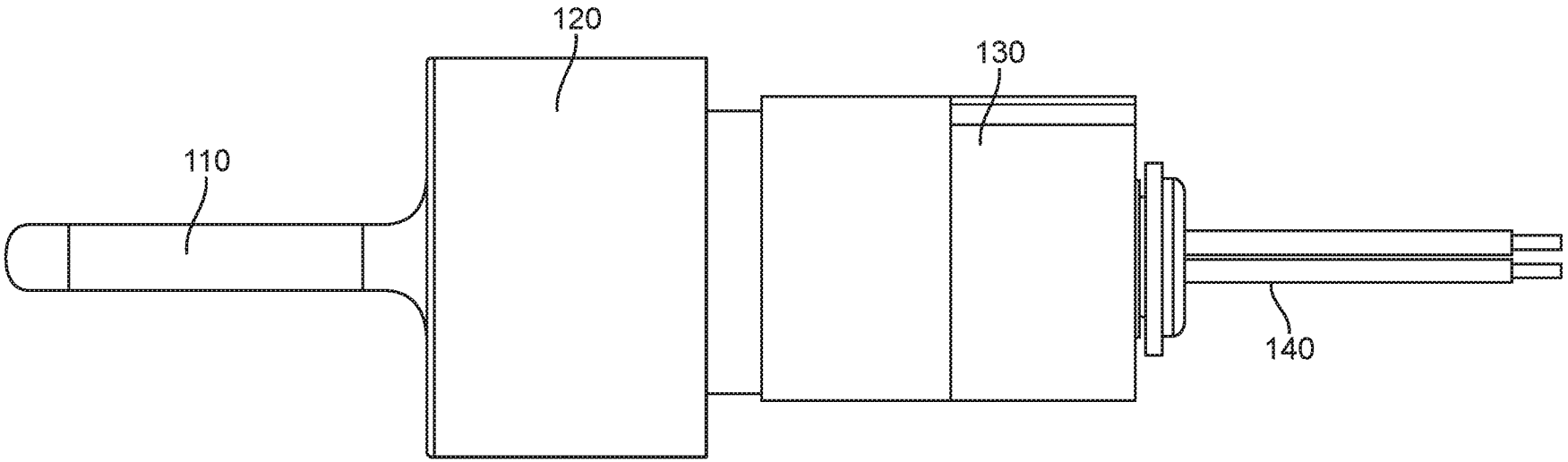
FIG. 3 illustrates a side view of a connector according to an embodiment of the present invention.

FIG. 3 illustrates a side view of a connector according to an embodiment of the present invention. Again, collar 120 may mechanically secure connecting portion 110 to barrel 130. Wires 140 may emerge from a rear opening of barrel 130 and plunger (described in FIG. 6.).

Figure 4:
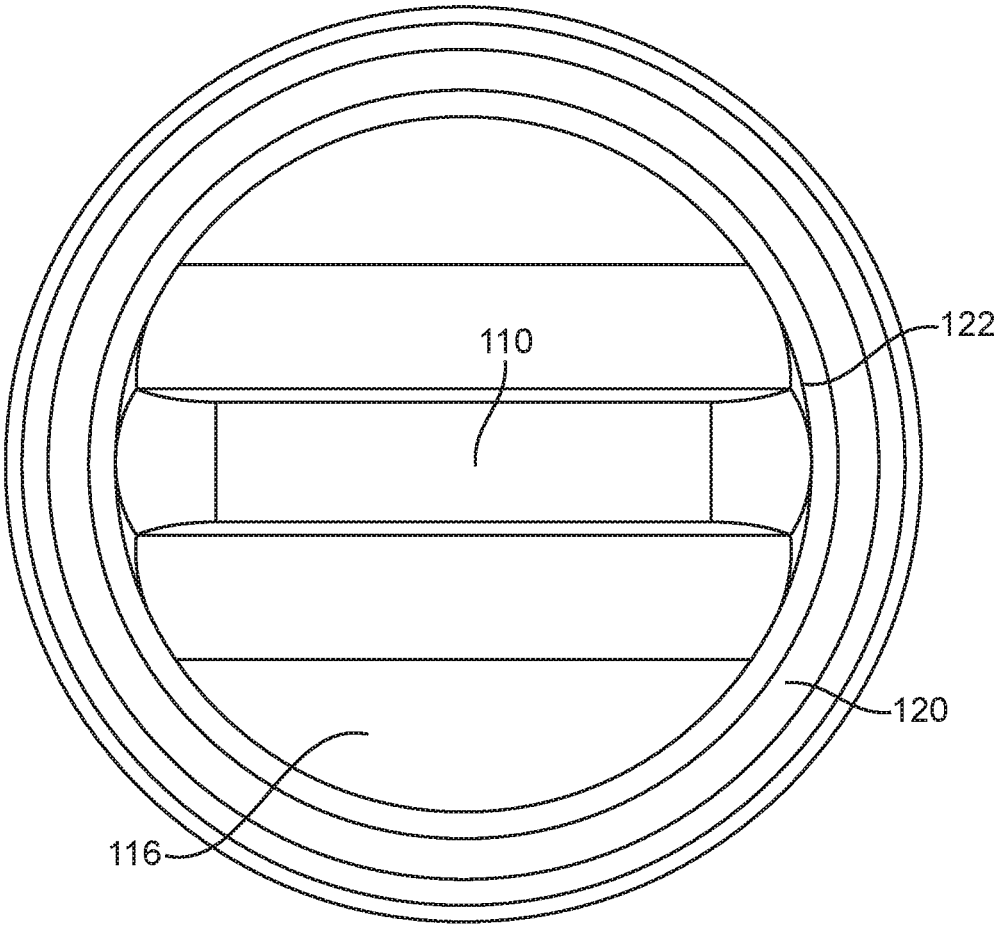
FIG. 4 illustrates a front view of a connector according to an embodiment of the present invention.

FIG. 4 illustrates a front view of a connector according to an embodiment of the present invention. Connecting portion 110 may taper to a flange 116. Tabs (not shown) on an outer edge of flange 116 may contact a back side of ring 122, which may be formed around an inside surface of collar 120.

In this example, connecting portion 110 is shown as an insert portion that may be inserted into a corresponding connector receptacle. In other embodiments of the present invention, connecting portion 110 may be a portion of a connector receptacle. In still other embodiments of the present invention, other types of connecting portions 110 may be used. For example, connecting portion 110 may include a housing supporting contacts located at a top and bottom of a central opening.

In this example, connecting portion 110 may be formed primarily of a conductive ground ring surrounding opening 114. Again, contacts 112 may be located in opening 114. A conductive ground ring on connecting portion 110 may be heat-treated or otherwise hardened to improve the durability of the connector. Collar 120 may be a machined metal ring, though in other embodiments of the present invention, collar 120 may be made using metal-injection molding, 3-D printing, plastic-injection molding, stamping, forging, or other process, and it may be formed of plastic or other materials. Collar 120 may be a portion of a device housing, or it may be in physical or electronic contact with a housing. Collar 120 may be conductive or nonconductive. Barrel 130 may also be conductive or nonconductive, and may be formed of metal, plastic, or other material.

In various embodiments of the present invention, collar 120 may be a portion of a device housing or attached to a device housing. Connecting portion 110 may be inserted into a corresponding connector on an electronic device. During use, an inadvertent or other force may be applied to a device housing to which collar 120 is connected or part of. Without more, this force may damage the corresponding receptacle into which connecting portion 110 is inserted and its device, the connector and its device, or both.

Accordingly, embodiments of the present invention may provide a connector having a connecting portion that may move relative to the device that includes the connector. In various embodiments of the present invention, the connecting portion may be free to move relative to the device in any direction. However, without more, this freedom may lead to a rotation of the connecting portion relative to the device. If a connecting portion rotates relative to device, wires that connect the connecting portion to the device may become twisted and damaged over time. Accordingly, embodiments of the present invention may instead limit the rotation of the connecting portion. This limitation may provide a position restore feature that may help to prevent the connecting portion from rotating relative to the device such that the connecting portion may return to an original orientation relative to the device following a deflection of the connecting portion. An example is shown in the following figure.

Figure 5:
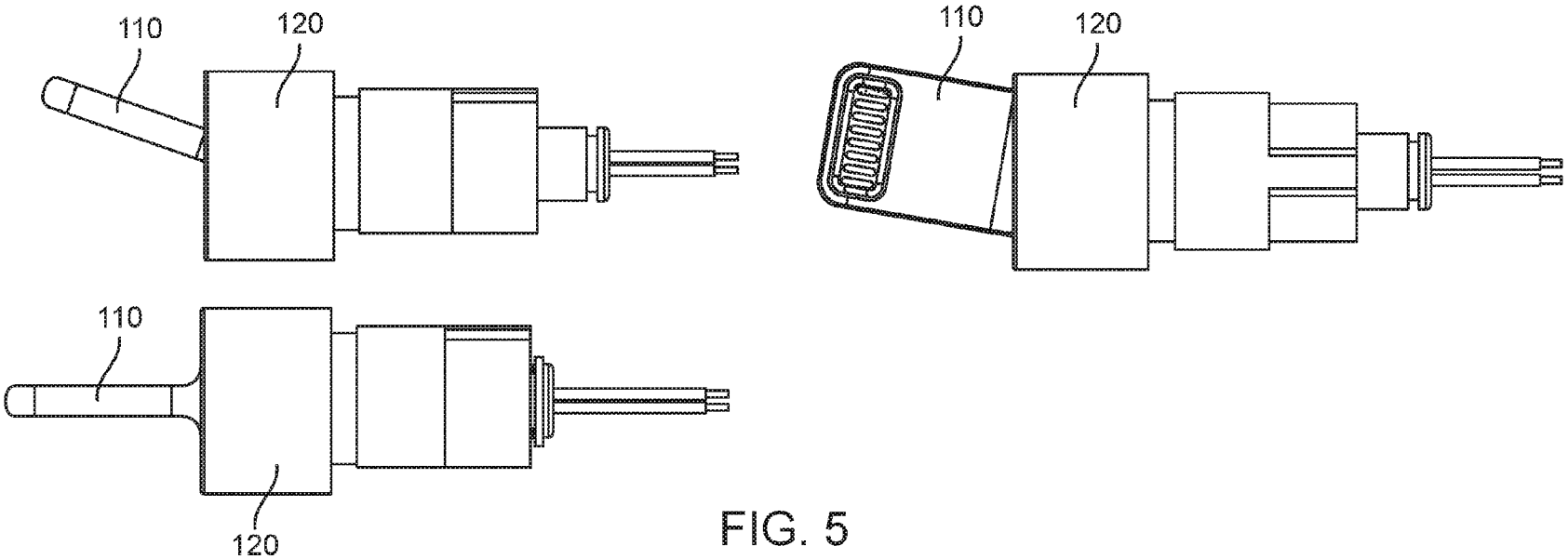
FIG. 5 illustrates the possible movement of a connecting portion relative to a device that includes the connector.

FIG. 5 illustrates the possible movement of a connecting portion relative to a device that includes the connector. In this example, connecting portion 110 may move relative to collar 120. Collar 120 may be a part of or attached to a housing for a device that includes this connector. Specifically, connecting portion 110 may tilt up and down relative to collar 120, and connecting portion 110 may move side to side relative to collar 120. That is, connecting portion 110 may have a major axis in a first direction and a minor axis in a second direction. Connecting portion 110 may tilt in either the first direction or the second direction. In these and other embodiments of the present invention, connecting portion 110 may tilt in the first direction, the second direction, or directions between the first direction and the second direction relative to collar 120. In these and other embodiments of the present invention, structures on connecting portion 110 and collar 120 may limit the amount that the connecting portion 110 may tilt or deflect relative to collar 120. In these and other embodiments of the present invention, this deflection may vary. For example, the deflection may be 8, 10, 11, 20, 25, 30, degrees or other amount of deflection. In these and other embodiments of the present invention, the connecting portion 110 may be able to be pushed directly backward a distance into collar 120. Structures on connecting portion 110 and collar 120 may also limit a rotation of connecting portion 110 relative to collar 120. This limitation may provide a positive restore feature such that connecting portion 110 may return to an original orientation relative to the collar 120 following a deflection of the connecting portion 110.

In various embodiments of the present invention, a spring inside the connector may be used to allow this compliance for the connector insert portion while also providing a force to return the connecting portion to a normal position after force is removed. The spring may provide sufficient force against the flange to prevent movement by the connector portion in the absence of energy or force applied to the connector portion. This may also discourage users from casually applying force to the connector portion. An example is shown in the following figure.

Figure 6:
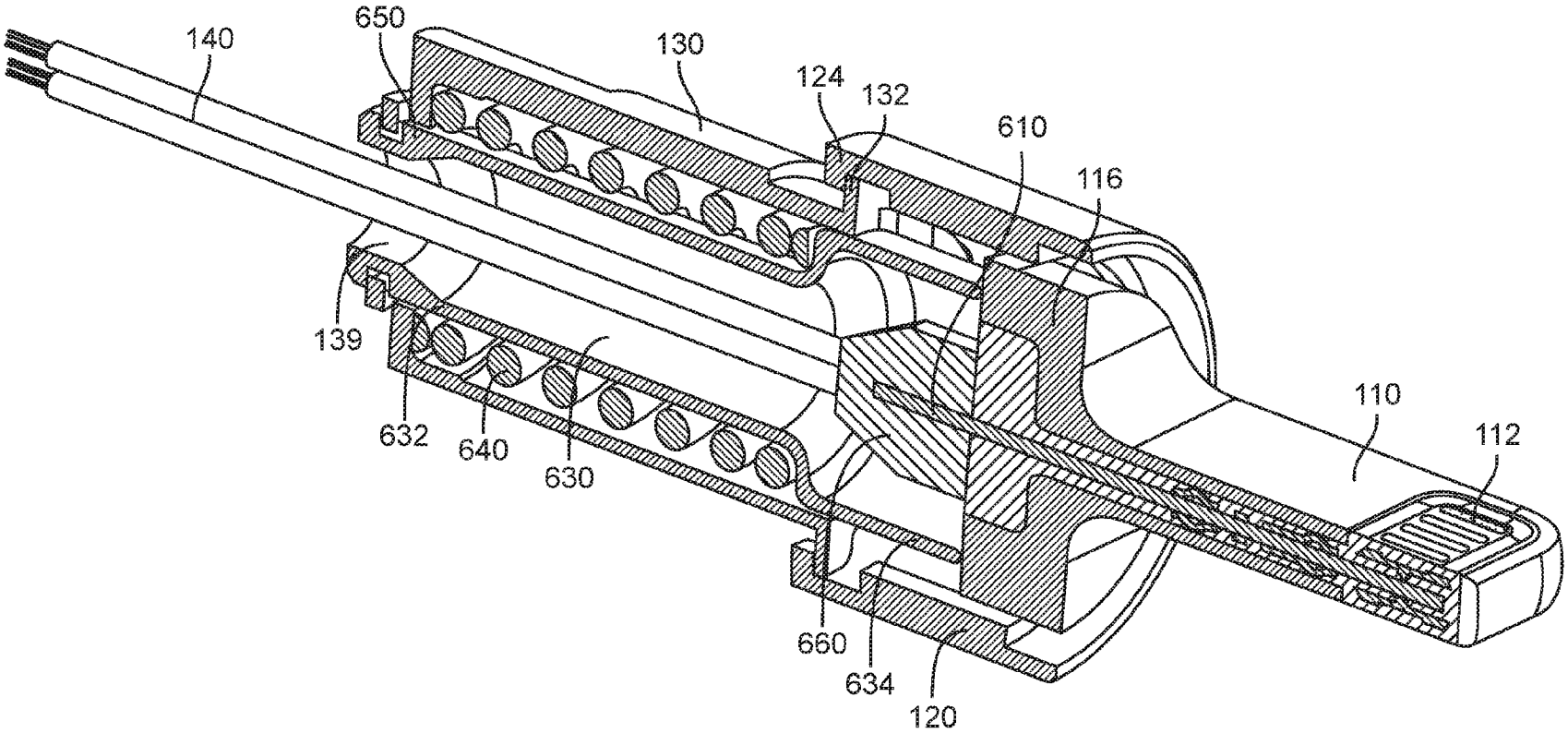
FIG. 6 illustrates a cutaway side view of a connector according to an embodiment of the present invention.

FIG. 6 illustrates a cutaway side view of a connector according to an embodiment of the present invention. In this example, a plunger 630 may have a narrow portion 632 that tapers to a wider portion 634. Narrow portion 632 may be inserted through the coils of spring 640. Plunger 630 and spring 640 may be inserted into barrel 130, such that spring 640 is located between a rear of barrel 130 and wide portion 634 of plunger 630. An end of narrow portion 632 of plunger 630 may extend through an opening 130 in rear of barrel 130. A C-clip or other fastener 650 may secure the end of narrow portion 632 of plunger 630 relative to barrel 130. In this way, spring 640 may apply a force pushing plunger 630 out of barrel 130. However, C-clip 650 may prevent this and block the end of plunger 630 from passing through opening 139 in the rear of barrel 130. In this way, spring 640, plunger 630, barrel 130, and C-clip 650 may provide a stable, self-contained unit.

Connecting portion 110 may have a rear portion that widens to flange 116. Flange 116 may include one or more tabs (not shown.) A front of connecting portion 110 may be inserted into a rear opening of collar 120 and moved forward until the tabs encounter a ring (not shown) around an inside surface of collar 120. Barrel 130 may then be inserted and secured in collar 120. Specifically, tabs 132 on barrel 130 may engage tabs 124 on collar 120, thereby securing barrel 130 in place. Wires 140 may electrically connect to board 610. Board 610 may in turn electrically connect to contacts 112 on connecting portion 110. A strain relief 660 may be molded around an end of board 610 and the connections to wires 140.

In this way, connecting portion 110 may move relative to collar 120 when a force is applied to connecting portion 110. Specifically, flange 116 may move backward relative to collar 120, thereby pushing plunger 630 backward and compressing spring 640. When the force is removed, spring 640 may decompress, thereby pushing connecting portion 110 back into place.

The ability of connecting portion 110 to move relative to collar 120 may prevent damage to this connector and its device. It may also help protect a corresponding connector that connecting portion 110 is mated with and a second device attached to or housing the corresponding connector.

In some instances, a device attached to or housing this connector may experience a force that is greater than what may be accommodated by this flexibility. Accordingly, embodiments of the present invention may provide a connector that is designed to break before damage to a corresponding mated connector and device occurs. In one example, tabs 132 on barrel 130 may be designed to break before a mated connector on a second device breaks. This may sacrifice a lower cost device that is attached to or houses this connector in favor of a more expensive second device.

When this connector does break, it may be undesirable for spring 640, which may be typically under compression, to be ejected from barrel 130. Accordingly, as discussed above, plunger 630, barrel 130, spring 640, and C-clip 650 may form a unit that may stay together as a piece after sacrificial tabs 132 have broken. In this way, spring 640 may remain contained in barrel 130 and plunger 630. Specifically, plunger 630 may have a narrow end 630 surrounded by spring 640. Plunger 630 may taper to a wider portion 634. Spring 640 may be held in place between an end of barrel 130 and wide portion 634 of plunger 630, and around narrow end 632 of plunger 630. An end of plunger 630 may extend beyond a rear portion of barrel 130. A C-clip or other fastener may be used to secure the end of plunger 630 beyond a rear of barrel 130. In this way, as spring 640 applies tension in a direction to eject plunger 630 from barrel 130, plunger 630 is held in place relative to barrel 130 by C-clip 650. Again, following a break or section of this connector, spring 640 may remain encased between barrel 130 and plunger 630 and may not be ejected from barrel 130.

Figure 7:
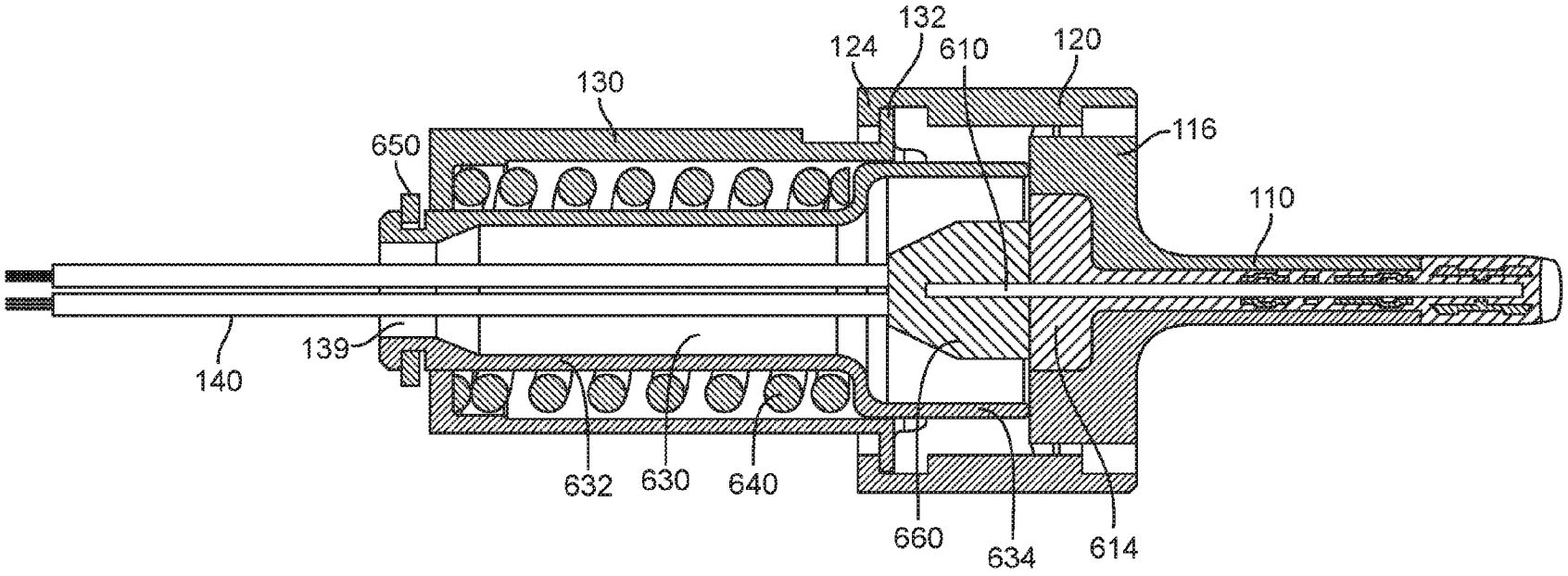
FIG. 7 illustrates a cutaway side view of a connector according to an embodiment of the present invention.

FIG. 7 illustrates a cutaway side view of a connector according to an embodiment of the present invention. Again, plunger 630 may have a narrow portion 632 surrounded by spring 640. Plunger 630 may have a wider portion 634. Plunger 630 may be inserted into barrel 130 such that an end of narrow portion 632 extends through an opening 139 in a rear of barrel 130. Locking or C-clip 650 may be used to prevent the ejection of plunger 630. Plunger 634 may push against a back of flange 116, which may be a wide portion of connecting portion 110. Flange 116 may include tabs that encounter a ring around and inside surface of collar 120. This ring may prevent the forward travel of connecting portion 110, but may allow connecting portion 110 to move backward when a force is applied. Barrel 130 may be secured to collar 120 by tabs 132 which may interlock with tabs 124 on collar 120. Wires 140 may be soldered to contacts on board 160. Board 160 may extend beyond a back of the flange 116. A strain relief 660 may be formed around terminal ends of wires 140 and board 610 to protect wires 140. Wires 140 may be specifically selected for their flexibility and the ability to withstand repeated stress.

Figure 8:
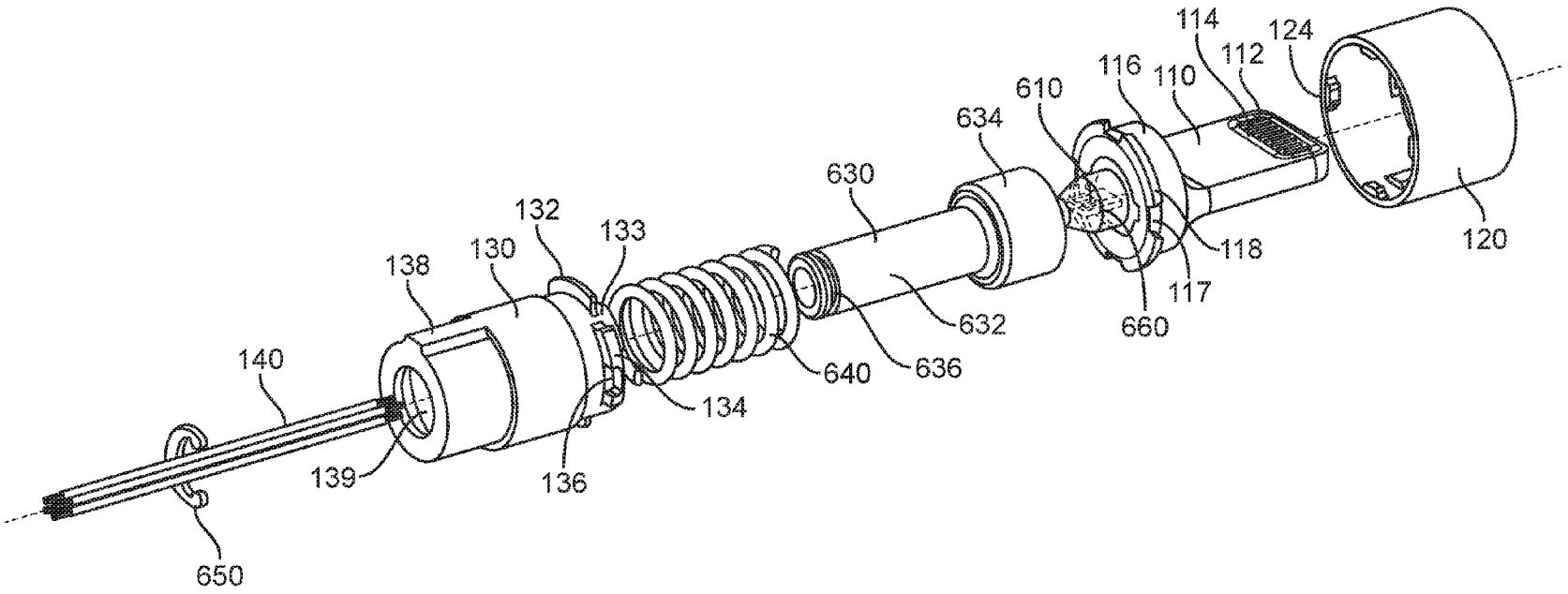
FIG. 8 illustrates an exploded view of a connector according to an embodiment of the present invention.

FIG. 8 illustrates an exploded view of a connector according to an embodiment of the present invention. This connector may include a collar 120 having tabs 124 near a rear opening. Connecting portion 110 may support a number of contacts 112 in an opening 114. Connecting portion 110 may taper to a wider flange portion 116. Tabs 118 and spaces 117 may be formed on flange 116. Spaces 117 may be aligned with tabs 124 on collar 120 and the front of connecting portion 110 may be inserted through the rear opening of collar 120. A ring (not shown) near a front opening of collar 120 may stop the forward travel of flange 116 and connecting portion 110.

A spring 640 may be placed over a narrow portion 632 of plunger 630. Plunger 630 and spring 640 may be inserted into barrel 130 such that a narrow portion 632 of plunger 630 extends through opening 139 of barrel 130. A C-clip or other locking clip 650 may be inserted into slot 636 on plunger 630 to prevent plunger 630 from being forced out of barrel 130 by spring 640. Spaces 132 on plunger 130 may be aligned with tabs 124 on collar 120. Barrel 130 may then be turned such that tabs 124 on collar 120 are held in place in notches 136 in tabs 134 on barrel 130. Barrel 130 may include clocking features 138, which may be used to align this connector to its device during assembly. Board 610 may extend from a back of flange 116 and may include one or more contacts to which wires 140 may be soldered. A strain relief 660 may be formed around the ends of wires 140 to protect them during use.

Figure 9:
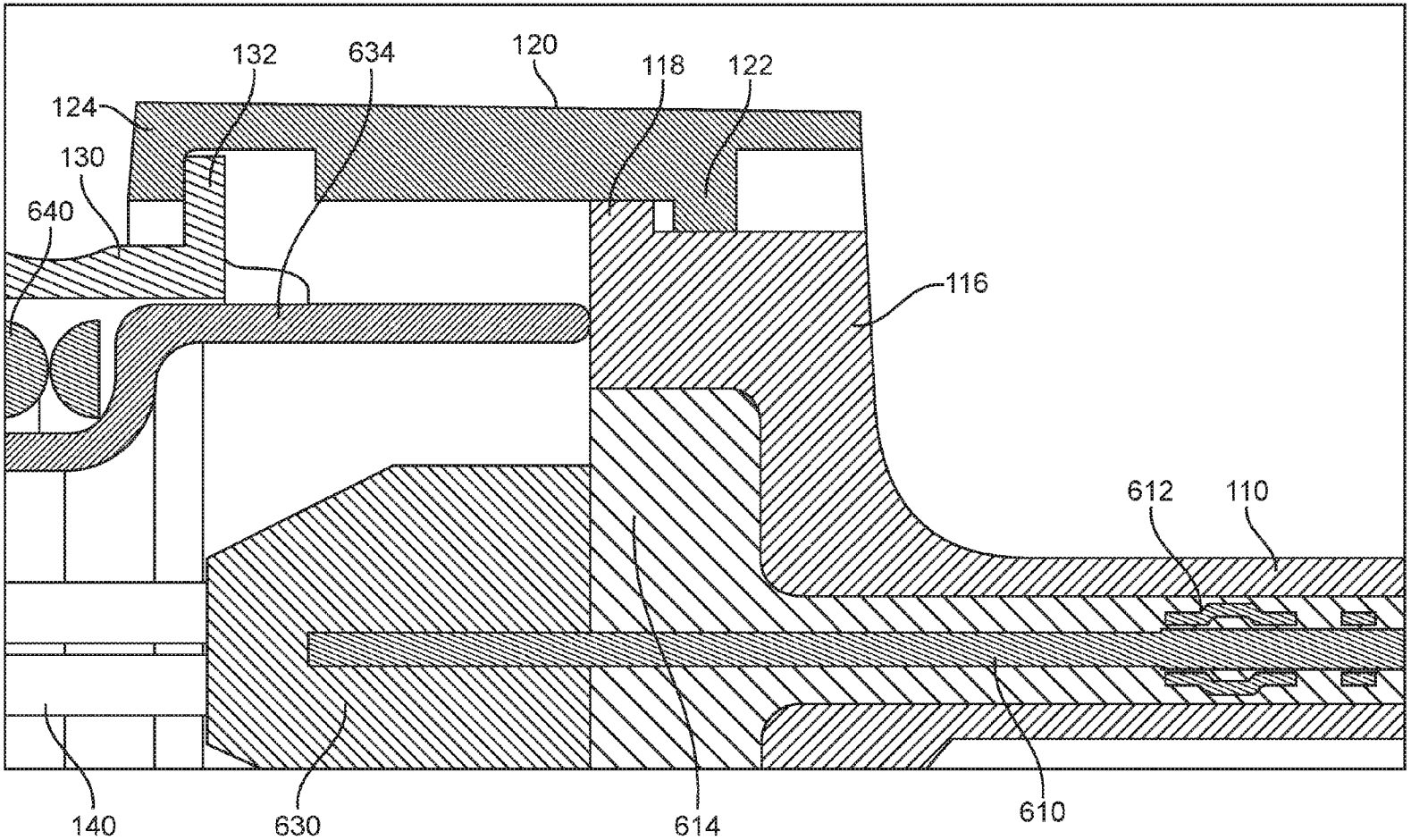
FIG. 9 illustrates a close-up view of interlocking features used to assemble a connector according to an embodiment of the present invention.

FIG. 9 illustrates a close-up view of interlocking features used to assemble a connector according to an embodiment of the present invention. Again, barrel 130 may include tabs 132. Tabs 132 may be held in place by tabs 124 on collar 120. The interlocking tabs 132 and 124 may prevent barrel 130 from being pushed out of the back of collar 120. Collar 120 may further include a ring 122 near a front opening of collar 120. Ring 122 may limit a travel of tabs 118, thereby providing a forward position for flange 116 and connecting portion 110. To improve appearance, portions of ring 122 and tabs 118 may be coated with PTFE or otherwise darkened for appearance purposes.

During assembly, board 610 may be formed. One or more components, capacitors, active devices, passive devices, integrated circuits, or other electrical or mechanical components 612 may be placed on board 610. A first overmold 614 may be formed around board 610 and components 612. First overmold 614 may be nonconductive. A second conductive metallic or overmold may form the ground ring, flange 116, and tabs 118. This second overmold may be formed by metal injection molding or other process. Wires 140 may be soldered to an end of board 610. A strain relief 630 may be over-molded at a rear of the flange 116 to protect wires 140 during operation of the device.

Figure 10:
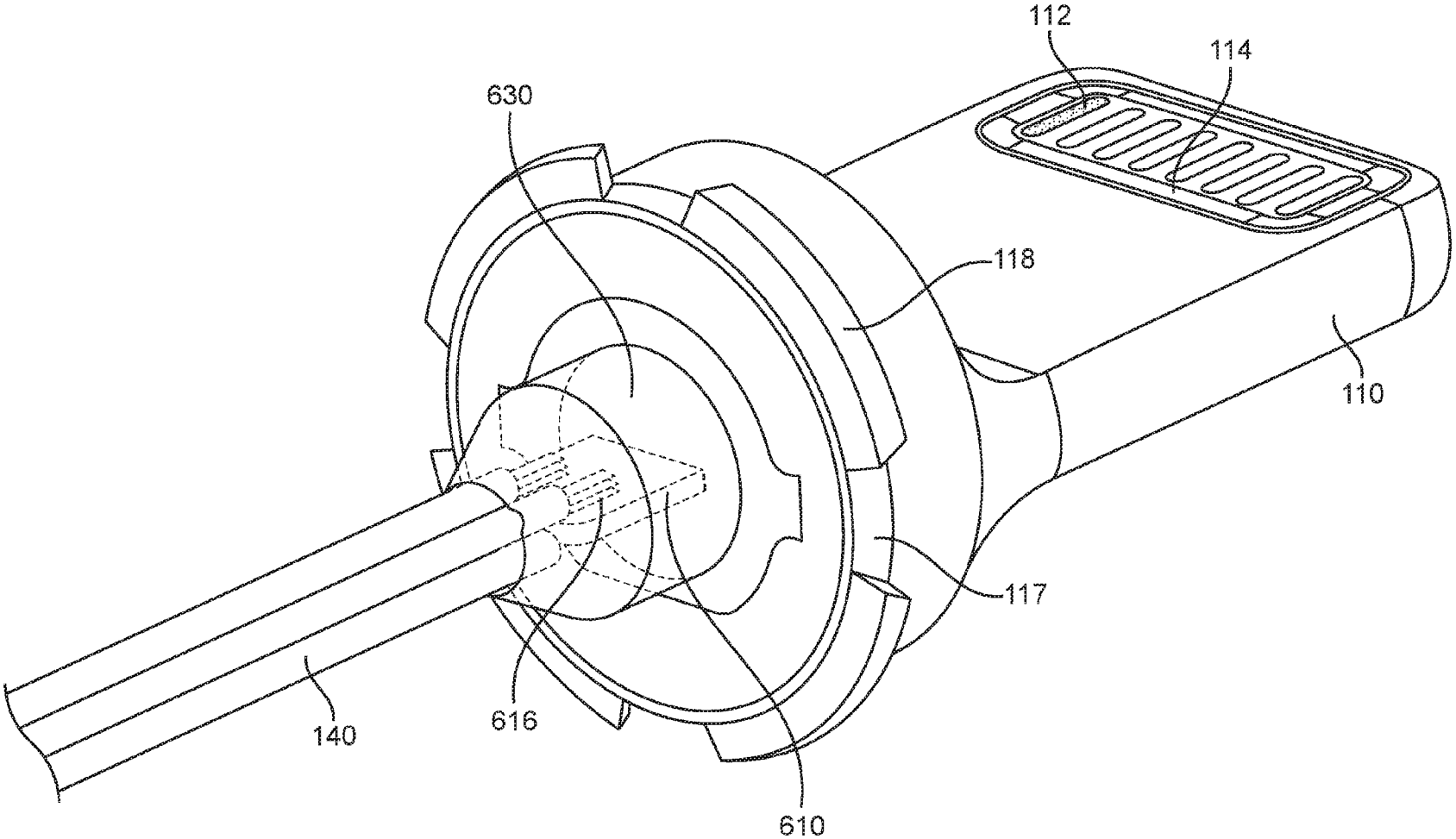
FIG. 10 illustrates a close-up view of a connecting portion for a connector according to an embodiment of the present invention.

FIG. 10 illustrates a close-up view of a connecting portion for a connector according to an embodiment of the present invention. Again, connecting portion 110 may support contacts 112 in open area 114. Connecting portion 110 may include tabs 118 that may be spaced apart by spaces 117. Again, during assembly, spaces 117 may be aligned with tabs 124 on collar 120 as connecting portion 110 is inserted into collar 120. Board 610 may emerge from a rear of connecting portion 110 and may support contacts 616. Ends of wires 140 may be soldered to contacts 616. A strain relief 630 may be formed around the end of board 610, contacts 616, and ends of wires 140 to protect these soldered connections and wires 140.

Figure 11:
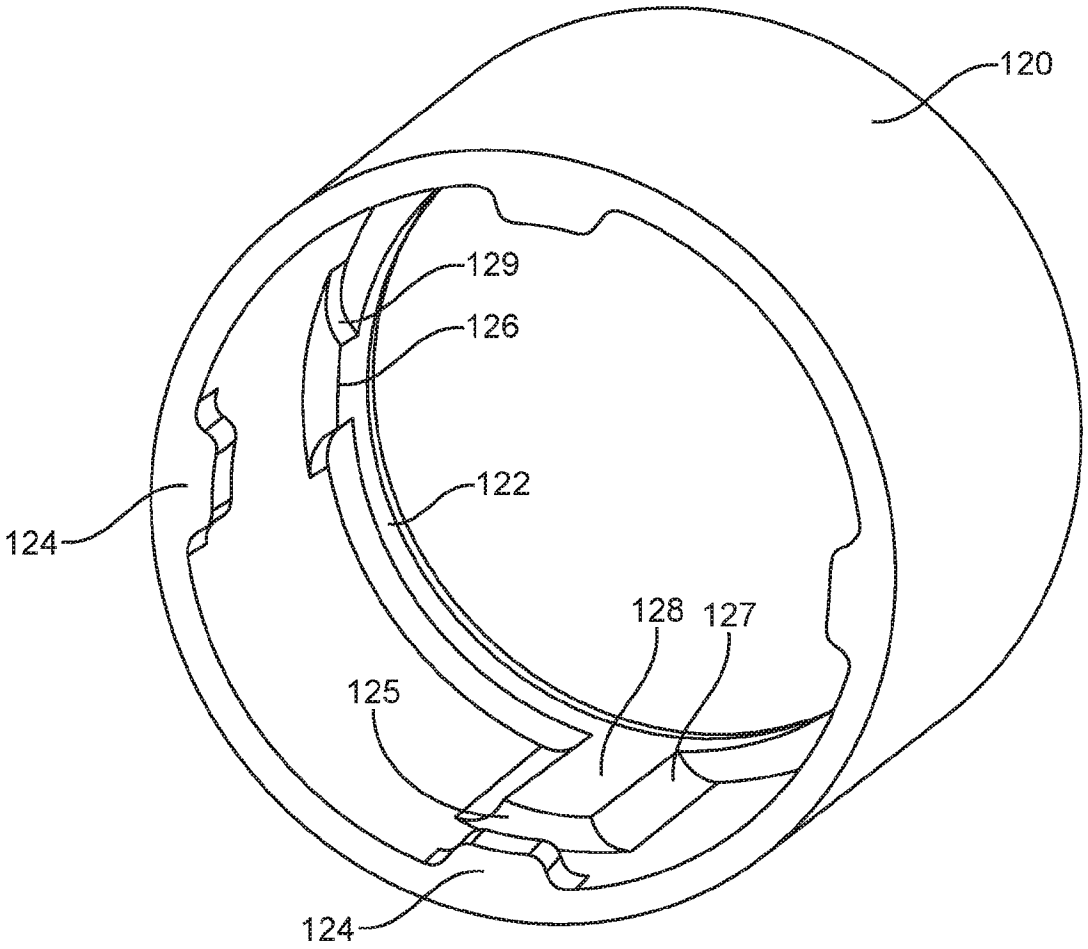
FIG. 11 illustrates a collar that may be used in a connector according to an embodiment of the present invention.

FIG. 11 illustrates a collar that may be used in a connector according to an embodiment of the present invention. Collar 120 may include a ring 122. Ring 122 may limit forward travel of tabs 118 on connecting portion 110. Collar 120 may further include tabs 124. Spaces 117 on connecting portion 110 may be aligned with tabs 124 while connecting portion 110 is inserted into collar 120. Ribs 126 and 128 may limit the rotation of connecting portion 110 relative to collar 120. Specifically, tabs 118 on connecting portion 110 and ribs 126 and 128 on collar 120 may prevent rotation of connecting portion 110 relative to collar 120. This limitation may provide a positive restore feature such that connecting portion 110 may return to an original orientation relative to the collar 120 following a deflection of the connecting portion 110. Specifically, ribs 126 and 128 on collar 120 and the tabs 118 on the flange of the connecting portion 110 may help to limit a rotation of the connecting portion 110 relative to the collar 120 during and after a deflection. As a force causing the deflection ceases, a force provided by spring 640 (as shown in FIG. 6) against the flange of the connecting portion 110 may move the connecting portion 110 forward towards its original position. Tabs 118 on the flange of the connecting portion 110 and ribs 126 and 128 on the collar may guide connecting portion 110 such that its original orientation is restored. Ribs 126 and 128 may include side ramps 129 and 127 to help guide connecting portion 110 back its original orientation.

Figure 12:
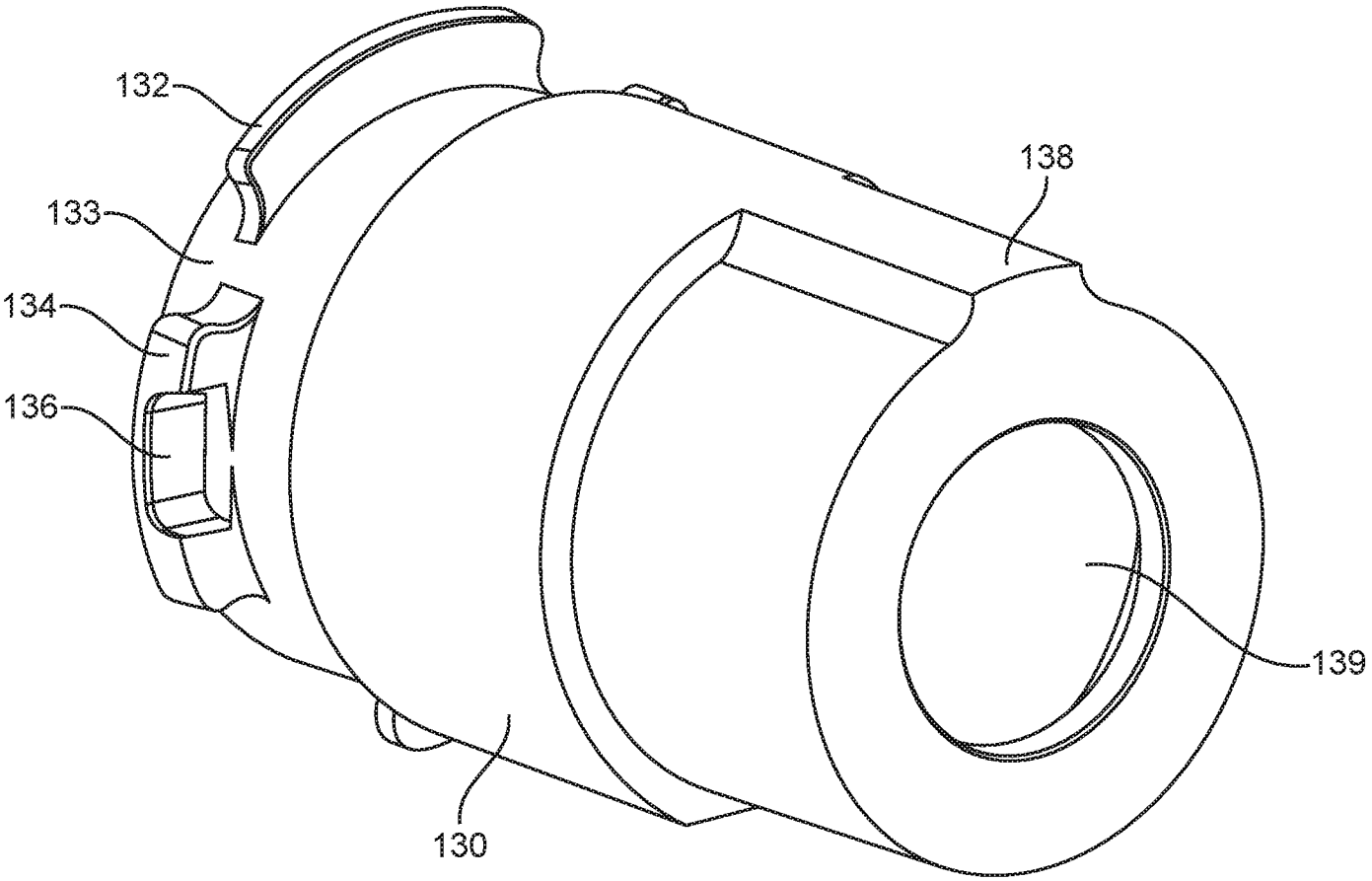
FIG. 12 illustrates a barrel that may be used in a connector according to an embodiment of the present invention.

FIG. 12 illustrates a barrel that may be used in a connector according to an embodiment of the present invention. Barrel 130 may include tabs 132 and 134 having spaces 133 between them. Spaces 133 may be aligned with tabs 124 during assembly. During assembly, tabs 132 and 134 may be pushed into collar 120. Barrel 130 may then be rotated such that recesses 136 on tabs 134 are aligned with one of the tabs 124 on collar 120. Barrel 130 may then be released such that tab 124 on collar 120 is held captive in notch 136 in tab 134 on barrel 130. Tab 124 on collar 120 may be fixed to tab 134 on barrel 130 by soldering, spot welding, or laser welding to secure barrel 130 to collar 120. In a specific embodiment of the present invention, tabs 132 may reside in gaps 125 between tabs 124 and 128, though in other embodiments of the present invention, tabs 134 may reside in gaps 125 between tabs 124 and 128. Barrel 130 may further include a rear opening 139 through which an end of plunger 630 and wires 140 may pass.

In various embodiments of the present invention, the components of the connectors may be formed in various ways of various materials. For example, contacts and other conductive portions may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle housings, contact pucks, and other portions, may be formed using injection or other molding, 3-D printing, machining, stamping, forging, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide connectors that may be located in, and may connect to, various types of devices, such as portable computing devices, tablet computers, desktop computers, laptops, all-in-one computers, wearable computing devices, cell phones, smart phones, media phones, storage devices, keyboards, covers, cases, styluses, portable media players, navigation systems, monitors, power supplies, adapters, remote control devices, chargers, and other devices. These connectors may provide pathways for signals that are compliant with various standards such as Universal Serial Bus (USB), High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a connecting portion supporting a plurality of contacts near a front end and having a flange at a back end;

a collar to fit over the flange and mechanically limit the travel of the flange in a forward direction while allowing at least a portion of the flange to travel at least a limited amount in a backward direction;

a barrel secured to a rear of the collar by a first plurality of tabs on the barrel;

a spring in the barrel, the spring compressed to push a rear portion of the flange in the forward direction;

a plunger in the barrel, the plunger having a narrow portion surrounded by the spring and tapering to a wider portion, wherein an end of the narrow portion of the plunger extends through an opening in a rear portion of the barrel; and a fastener at the end of the narrow portion of the plunger, wherein when one or more of the first plurality of tabs on the barrel break, the fastener secures the barrel to the plunger, thereby preventing the spring from exiting the barrel.

2. The connector of claim 1 wherein the plunger tapers to a wider portion, the wider portion between the spring and a back of the flange.

3. The connector of claim 2, wherein the collar includes an inside raised portion to limit the travel of the flange in the forward direction.

4. The connector of claim 3, wherein the connecting portion comprises a first portion of the plurality contacts in a first opening and a second portion of the plurality of contacts in a second opening, the first opening and the second opening surrounded by a ground ring.

5. The connector of claim 1, wherein the first plurality of tabs are designed to break before damage occurs to a device that the connector is connected to.

6. The connector of claim 1, wherein the fastener is a C-clip around the end of the narrow portion of the plunger.

7. The connector of claim 1, wherein the fastener is a locking-clip.

8. The connector of claim 3, wherein the flange comprises a second plurality of tabs having intervening spaces, the spaces aligned with ribs on an inside surface of the collar to prevent rotation of the connecting portion relative to the collar.

9. The connector of claim 8, wherein the second plurality of tabs on the flange and the ribs on the inside surface of the collar provide a positive restore feature such that connecting portion returns to an original position relative to the collar following a deflection.

10. The connector of claim 1, further comprising:

a plurality of wires attached to a rear portion of the flange; and a strain relief formed around ends of the wires at the rear portion of the flange.

11. The connector of claim 1, wherein the fastener allows the plunger to be depressed into the barrel and prevents the plunger from exiting the barrel.

12. A method of manufacturing a connector, the method comprising:

inserting a front end of a connecting portion into a rear opening of a collar, the connecting portion supporting a plurality of contacts near the front end and having a flange at a back end, the collar to mechanically limit the travel of the flange in a forward direction while allowing at least a portion of the flange to travel at least a limited amount in a backward direction;

inserting a spring into a barrel;

placing a plunger in the barrel such that the spring is in the barrel and around a narrow portion of the plunger and an end of the narrow portion of the plunger passes through an opening in a rear of the barrel;

placing a fastener at the end of the narrow portion of plunger extending through the opening in the rear of the barrel; and securing the barrel to the collar by aligning tabs on a front end of the barrel to features on an inside of the collar, inserting the front end of the barrel into a rear opening of the collar, and twisting the barrel to lock the tabs to features on the inside of the collar, wherein when one or more of the tabs on the barrel break, the fastener secures the barrel to the plunger, thereby preventing the spring from exiting the barrel.

13. The method of claim 12, wherein the plunger tapers to a wider portion, the wider portion between the spring and a back of the flange.

14. The method of claim 12, wherein the fastener is a C-clip around the end of the narrow portion of the plunger.

15. The method of claim 14, wherein the barrel is further secured to the collar by laser welding the tabs on the front end of the barrel to the features on the inside of the collar.

16. The method of claim 15, wherein the tabs are designed to break before damage occurs to a device that the connector is connected to.

17. The method of claim 12, wherein the fastener is a locking-clip.

18. The method of claim 12, wherein the collar comprises a ring around the inside of the collar near a front opening, wherein the ring limits the travel of the flange in the forward direction.

19. The method of claim 18, wherein the spring is compressed such that the spring pushes the flange against the ring around the inside of the collar.

20. The method of claim 19, further comprising:

attaching a plurality of wires to a back of the flange; and forming a strain relief around ends of the wires at the back of the flange.

* * * * *